US008091589B2

(12) United States Patent
Yokokawa

(10) Patent No.: US 8,091,589 B2
(45) Date of Patent: Jan. 10, 2012

(54) LOOM AND DRIVE DEVICE OF LOOM

(75) Inventor: Narutoshi Yokokawa, Mishima (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 7 days.

(21) Appl. No.: 12/513,240

(22) PCT Filed: Sep. 1, 2008

(86) PCT No.: PCT/JP2008/065645

§ 371 (c)(1),
(2), (4) Date: May 1, 2009

(87) PCT Pub. No.: WO2009/031488

PCT Pub. Date: Mar. 12, 2009

(65) Prior Publication Data

US 2011/0000576 A1 Jan. 6, 2011

(30) Foreign Application Priority Data

Sep. 5, 2007 (JP) ..... 2007-230043

(51) Int. Cl.
*D03D 49/06* (2006.01)
*D03D 49/12* (2006.01)
*D03D 49/18* (2006.01)
*D03D 49/00* (2006.01)

(52) U.S. Cl. ..... 139/110; 139/1 E; 700/140

(58) Field of Classification Search ..... 318/701, 318/254; 139/110; 388/811
See application file for complete search history.

(56) References Cited

U.S. PATENT DOCUMENTS 3,802,467 A * 4/1974 Steverlynck ..... 139/108
3,878,872 A * 4/1975 Hintsch ..... 139/99
4,513,790 A * 4/1985 Sainen et al. ..... 139/110
4,585,037 A * 4/1986 Kimbara ..... 139/1 E
4,593,236 A * 6/1986 Oesterle et al. ..... 318/7
(Continued)

FOREIGN PATENT DOCUMENTS

JP 59-199841 11/1984
(Continued)

OTHER PUBLICATIONS

International Search Report of PCT/JP2008/065645.
(Continued)

*Primary Examiner* — Bobby Muromoto, Jr.
(74) *Attorney, Agent, or Firm* — DLA Piper LLP US

(57) ABSTRACT

A loom (1) has feed motor (27) rotating a warp beam (3) in a direction to feeding warps (V) from the warp beam (3), a heddles (10) opening and closing the warps (V) fed off from the warp beam (3), a reed (13) beating wefts (H) inserted into the openings of the warps (V) by a weft inserting device (11), a surface motor (61) rotating a surface roller (17) to pull in the woven fabric (W), which has been beaten by the reed (13) and formed of the warps (V) and the wefts (H), in the pulling direction, a position detector (35) detecting the tension of the warps (V), and a control device 25 having an adaptive filter unit (83) filtering the tension detected by the position detector (35), and controlling the feed motor (27) and the surface motor (61) on the basis of the tension filtered by that adaptive filter unit (83) so that the tension of the warps (V) to a predetermined target tension.

5 Claims, 7 Drawing Sheets

U.S. PATENT DOCUMENTS

| | | | | |
|---|---|---|---|---|
| 4,605,044 | A * | 8/1986 | Sakano | 139/304 |
| 4,619,294 | A * | 10/1986 | Sainen et al. | 139/99 |
| 4,817,677 | A * | 4/1989 | Deconinck et al. | 139/99 |
| 4,942,908 | A * | 7/1990 | Imamura | 139/99 |
| 5,024,253 | A * | 6/1991 | Kawabata et al. | 139/99 |
| 5,029,616 | A * | 7/1991 | Deconnick | 139/110 |
| 5,170,821 | A * | 12/1992 | Yoshida | 139/99 |
| 5,386,855 | A * | 2/1995 | Corain et al. | 139/99 |
| 5,487,413 | A * | 1/1996 | Hatakeyama et al. | 139/116.2 |
| 5,549,140 | A * | 8/1996 | Lindblom | 139/114 |
| 5,827,975 | A * | 10/1998 | De Jager et al. | 73/828 |
| 5,857,496 | A * | 1/1999 | Brown et al. | 139/110 |
| 6,269,844 | B1 * | 8/2001 | Zenoni et al. | 139/452 |
| 7,088,061 | B2 * | 8/2006 | Bilcke | 318/34 |
| 7,227,319 | B2 * | 6/2007 | Adriaen et al. | 318/3 |
| 7,895,010 | B2 * | 2/2011 | Yokokawa | 702/104 |
| 2009/0167296 | A1 * | 7/2009 | Yokokawa | 324/207.25 |

FOREIGN PATENT DOCUMENTS

| | | |
|---|---|---|
| JP | 02-210038 | 8/1990 |
| JP | 09-158004 | 6/1997 |
| JP | 2001-288645 | 10/2001 |

OTHER PUBLICATIONS

English Abstract of JP-2001-288645.
English Abstract of JP-09-158004.
English Abstract of JP-02-210038.
Machine English translation of JP-2001-288645.
Machine English translation of JP-09-158004.
Office Action issued in Korean Appl 10-2009-7009186 issued May 26, 2011.
English Translation of Office Action issued in Korean Appl 10-2009-7009186 issued May 26, 2011.

* cited by examiner

LOOM AND DRIVE DEVICE OF LOOM

TECHNICAL FIELD

The present invention relates to a loom and a drive device of a loom.

BACKGROUND ART

In a loom, a warp beam around which warps are wound is rotated by a feed motor so that the warps are fed out, wefts are inserted into openings of the warps formed by heddles, and the wefts are beaten down by a reed whereby a woven fabric is formed. The formed woven fabric is pulled in and taken up by rotation of a roller which abuts against the woven fabric by a pull-in motor.

Tension of the warps is preferably controlled constant from the viewpoint of keeping the quality of woven fabric constant. The tension of the warp is controlled by controlling the feed motor and the pull-in motor based on a detection value of the tension of the warps. Patent Document 1 discloses technology filtering the detection value of the tension by a low pass filter so as to for eliminate the effects of the heddles or reed on the tension and stabilize control of the tension.

Patent Document 1: Japanese Patent Publication (A) No. 2001-288645

DISCLOSURE OF THE INVENTION

Problem to be Solved by the Invention

If fluctuation is not eliminated by a filter, the operations of the feed motor and pull-in motor become unstable due to fluctuation of the tension caused by the heddles or reed. On the other hand, if the effect of elimination of fluctuation of the tension by the filter is made too great by setting an unsuitable filter coefficient etc., even fluctuations of the tension which should originally be tracked by rotations of the feed motor and the pull-in motor are eliminated, the responses of the feed motor and the pull-in motor to the fluctuations of the tension are lowered, and suitable tension is not obtained. Further, if the effect of elimination of fluctuation of the tension by the filter is made too great, the stability of the tension control is impaired, overshoot, undershoot, or vibration occurs, and the controllability is sometimes remarkably degraded. Accordingly, the filter coefficient of the filter must be suitably set.

On the other hand, the heddles and the reed are driven by a main motor different from the feed motor and the pull-in motor. The rotation of the main motor is transmitted through a gear mechanism, cam mechanism, link mechanism, or other transmission mechanism to the heddles and the reed. The periods of the heddles and reed and the drive timings (phase difference) of these relative to each other are defined by the transmission mechanism. Further, these period and phase difference differ according to the type of the loom or the type of the woven fabric (for example, plain weave, twill, satin weave, etc.) Further, structures including heddles, a reed, a transmission mechanism, main motor, and control device controlling the main motor and structures including a feed motor, pull-in motor, and a control device controlling these motors are frequently produced by different manufacturers.

Accordingly, irrespective of the fact that the filter coefficient of the filter for controlling the tension must be set in accordance with the structure including the main motor etc., the filter is produced by a manufacturer different from the manufacturer producing the structure including the main motor etc., so it has been difficult to suitably set the filter coefficient.

An object of the present invention is to provide a loom and a drive device of a loom able to suitably control the tension even if the drive period of the heddles and reed change.

Means for Solving the Problem

A loom of the present invention has a warp beam around which warps are wound, a feed motor rotating the warp beam in a direction feeding the warps, heddles opening and closing the warps fed from the warp beam, a picking device inserting wefts into the openings of the warps formed by the heddles, a reed beating down the wefts inserted in the openings by the picking device, a pull-in roller pulling in a woven fabric beaten down by the reed and formed by the warps and the wefts, a pull-in motor rotating the pull-in roller in a direction pulling in the woven fabric, a detector detecting a tension of the warps between the warp beam and the pull-in roller, and a control device having an adaptive filter filtering the tension detected by the detector and controlling the feed motor and the pull-in motor so that the tension of the warps becomes a predetermined target tension based on the tension filtered by the adaptive filter.

Preferably, the loom has a heddle linear motor driving the heddles and having a direction of movement of the heddles as a drive direction of a mover.

Preferably, the loom has a reed linear motor driving the reed and having a direction of movement of the reed as a drive direction of a mover.

Preferably, the control device has a synchronized operation setting part capable of changing driving periods of the heddle linear motor and the reed linear motor and drive timings of these relative to each other and controls the heddle linear motor and the reed linear motor based on the driving periods and drive timings changed by the synchronized operation setting part.

Preferably, the adaptive filter has a filter part filtering tension detected by the detector by using a plurality of first filter coefficients and a filter constant estimation part calculating the plurality of first filter coefficients, the filter part has a plurality of first delay elements sequentially delaying tension detected by the detector, a plurality of first multipliers multiplying outputs of the plurality of first delay elements by the first filter coefficients corresponding to the first delay elements, and a first accumulation part accumulating results of multiplication of the plurality of first multipliers and outputting the result of the accumulation as the filtered tension, the filter constant estimation part has a pass band signal generation part generating a pass band signal, an adder adding the tension detected by the detector and the pass band signal, an estimation filter part filtering results of addition of the adder by using a plurality of second filter coefficients, a subtractor calculating a deviation between the output filtered by the estimation filter part and the pass band signal, and a tap constant estimation part calculating a plurality of second filter coefficients so that the deviation becomes small, the estimation filter part has a plurality of second delay elements sequentially delaying results of addition of the adder, a plurality of second multipliers multiplying outputs of the plurality of second delay elements by the second filter coefficients corresponding to the delay elements, and a second accumulation part accumulating results of multiplication of the second multipliers and outputting the result of the accumulation as the filtering result, the tap constant estimation part calculates the plurality of second filter coefficients so that the deviation becomes small, and calculated plurality of second filter coefficients are set as the first filter coefficients in the filter part.

A drive device of a loom of the present invention has a feed motor rotating a warp beam around which warps are wound in a direction feeding the warps, a pull-in motor rotating a pull-in roller pulling in a woven fabric formed by beating wefts inserted into openings of the warps fed from the warp beam in a direction of pulling in the woven fabric, and a control device having an adaptive filter filtering the tension detected between the warp beam and the pull-in roller, and controlling the feed motor and the pull-in motor so that the tension of the warps becomes a predetermined target tension based on the tension filtered by the adaptive filter.

Effect of the Invention

According to the present invention, even if the driving periods of the heddles and reed change, the tension can be suitably controlled.

EXPLANATION OF NOTATIONS

1 . . . loom, 3 . . . warp beam, 10 . . . heddle, 11 . . . picking device, 13 . . . reed, 17 . . . surface roller (pull-in roller), 25 . . . control device, 27 . . . feed motor, 35 . . . position detector (detector), 83 . . . adaptive filter part, V . . . warp, H . . . weft, and W . . . woven fabric.

BEST MODE FOR CARRYING OUT THE INVENTION

Figure 1:
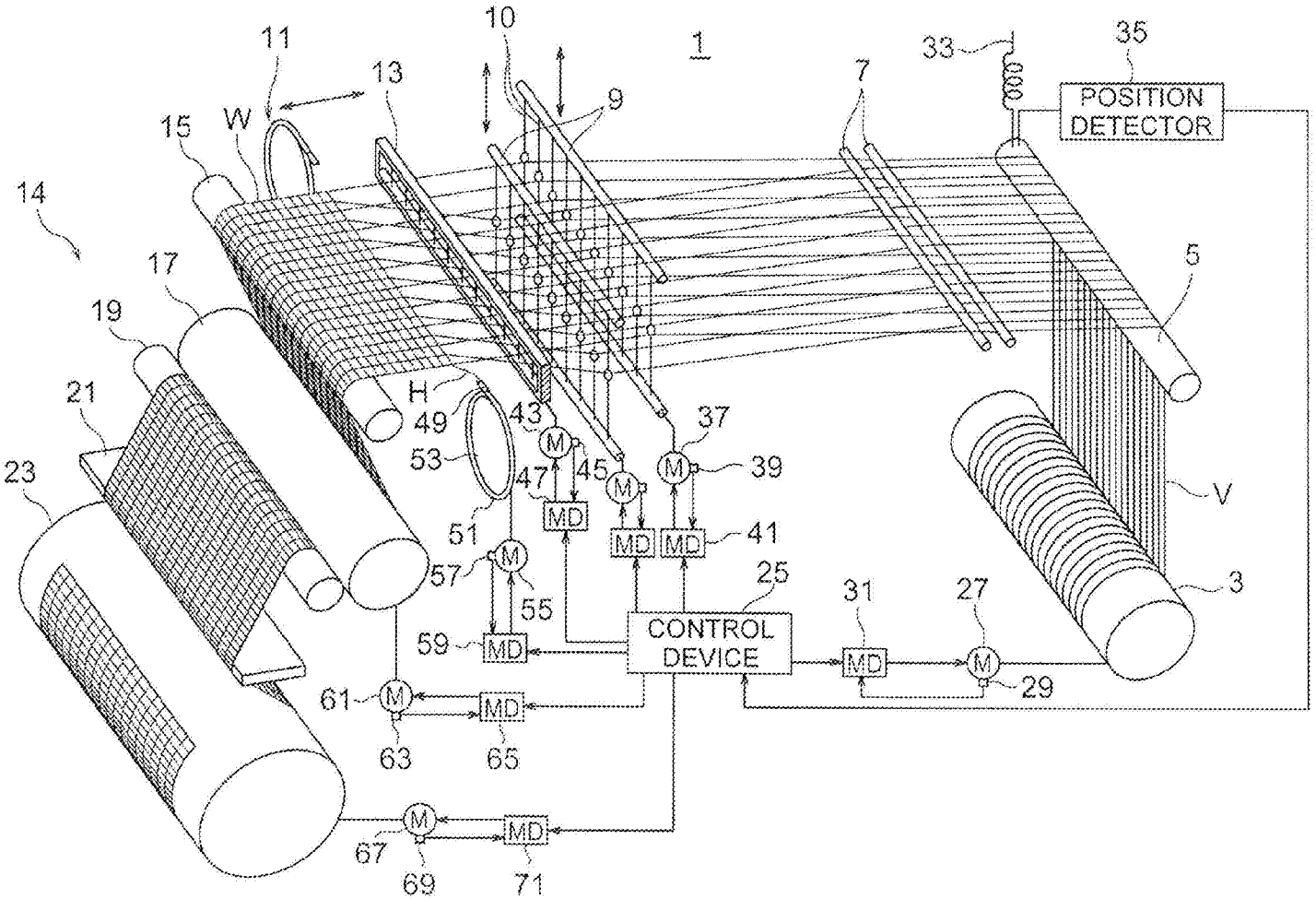
[FIG. 1] A diagrammatical view schematically showing an overall constitution of a loom of an embodiment of the present invention.

FIG. 1 is a schematic view schematically showing an overall constitution of a loom 1 according to an embodiment of the present invention. Note that the loom 1 may be arranged in any direction relative to the gravity direction. However, in the present embodiment, the explanation will be given assuming that the loom 1 is arranged so that a vertical direction of the sheet surface becomes an actual vertical direction.

The loom 1 has a warp beam 3 around which a plurality of warps V are wound and which feeds a plurality of warps V by rotating, a tension roller 5 guiding a plurality of warps V fed from the warp beam 3, a plurality of shed rods 7 dividing a plurality of warps V guided by the tension roller 5 to predetermined up and down positions, a plurality of heddle frames 9 forming openings by moving a plurality of warps V divided by the shed rods 7 up and down, a picking device 11 threading wefts H through openings formed by the heddle frames 9, a reed 13 beating the wefts H threaded through openings by the picking device 11, a take-up device 14 taking up a woven fabric W beaten by the reed 13 and formed by a plurality of warps V and wefts H, and a control device 25 controlling the operation of the loom 1.

The warp beam 3 is driven to rotate by for example a rotary type feed motor 27 directly or indirectly through a not shown gear train etc. The feed motor 27 is constituted by for example a servo motor and constitutes a servo mechanism together with an encoder 29 detecting rotation of the feed motor 27 and a servo driver 31 supplying electric power to the feed motor 27. The servo driver 31 performs feedback control based on a control signal input from the control device 25 to the servo driver 31 and a detection signal of the encoder 29 so that the position and/or speed of the feed motor 27 follows the input control signal.

The tension roller 5 is supported by a shaft rotatably along with the movement of a plurality of warps V. Further, the tension roller 5 constitutes a tension detection part detecting tension of the plurality of warps V together with a spring (biasing member) 33 and a position detector 35. The spring 33 biases the tension roller 5 to a direction so that tension is applied to the plurality of warps V by the tension roller 5. Namely, the tension roller 5 is located at a position where the force received by tension of the plurality of warps V and a biasing force of the spring 33 are balanced. Further, when the tension of the plurality of warps V fluctuates, the position of the tension roller 5 changes by exactly an amount proportional to the amount of the fluctuation. The position detector 35 detects the position of the tension roller 5 as a value showing the tension of the plurality of warps V and outputs a detection signal in accordance with the detection result to the control device 25.

The heddle frames 9 have attached to them the same number of heddles 10 through which the plurality of warps V are threaded as the plurality of warps V. The plurality of heddle frames 9 are driven by a heddle linear motor 37. The heddle linear motor 37 is constituted by for example a servo motor and constitutes a servo mechanism together with an encoder 39 detecting the position of the heddle linear motor 37 and a servo driver 41 supplying electric power to the heddle linear motor 37. The servo driver 41 performs feedback control based on a control signal input to the servo driver 41 from the control device 25 and a detection signal of the encoder 39 so that the position and/or speed of the heddle linear motor 37 follows the input control signal.

The reed 13 is driven by for example a reed linear motor 43. The reed linear motor 43 is constituted by for example a servo motor and constitutes a servo mechanism together with an encoder 45 detecting the position of the reed linear motor 43 and a servo driver 47 supplying electric power to the reed linear motor 43. The servo driver 47 performs feedback control based on a control signal input from the control device 25 to the servo driver 47 and a detection signal of the encoder 45 so that the position and/or speed of the reed linear motor 43 follows the input control signal.

The picking device 11 is constituted by for example a rapier type picking device and has two sets of rapier heads 49 capable to holding wefts H, rapier bands 51 to which the rapier heads 49 are fixed, and rapier wheels 53 around which the rapier bands 51 are wound, for transferring and for receiving the wefts H. By the rotation of the rapier wheels 53, the rapier head 49 transferring the wefts H and the rapier head 49 receiving the wefts H are inserted into openings of the plurality of warps V formed by the plurality of heddle frames 9.

At this time, the transferring rapier head 49 holds the wefts H. After the wefts H are transferred from the transferring rapier head 49 to the receiving rapier head 49, by reverse rotation of the rapier wheels 53, the rapier heads 49 retract from openings of the plurality of heddle frames 9. Due to this, the wefts H are inserted into openings of the plurality of warps V.

Each rapier wheel 53 is driven to rotate by, for example, a rotary type rapier motor 55 directly or indirectly through a not shown gear train or link mechanism etc. The rapier motor 55 is constituted by for example a servo motor and constitutes a servo mechanism together with an encoder 57 detecting the rotation of the rapier motor 55 and a servo driver 59 supplying electric power to the rapier motor 55. The servo driver 59 performs feedback control based on a control signal input from the control device 25 to the servo driver 59 and a detection signal of the encoder 57 so that the position and/or speed of the rapier motor 55 follows the input control signal. Note that, in the present embodiment, the rapier type is used, but for example an air jet type utilizing an air jet compressed by a compressor and a water jet type utilizing a water jet compressing water in the same way may be used as well.

The take-up device 14 has an expansion roller 15 guiding the woven fabric W, a surface roller 17 and a press roller 19 which nip the woven fabric W guided by the expansion roller 15, rotate, and pull in the woven fabric W, a wrinkle eliminating member 21 eliminating wrinkle of the woven fabric W pulled in by the surface roller 17 and the press roller 19, and a take-up roller 23 taking up the woven fabric W from which wrinkles are eliminated by the wrinkle eliminating member 21.

The expansion roller 15 is arranged to abut against the woven fabric W and is supported by a shaft rotatably along with the movement of the woven fabric W. The surface roller 17 is driven to rotate by for example a rotating surface motor 61 directly or indirectly through a not shown gear train etc. The surface motor 61 is constituted by for example a servo motor and constitutes a servo mechanism together with an encoder 63 detecting rotation of the surface motor 61 and a servo driver 65 supplying electric power to the surface motor 61. The servo driver 65 performs feedback control based on a control signal input from the control device 25 to the servo driver 65 and a detection signal of the encoder 63 so that the position and/or speed of the surface motor 61 follows the input control signal. The press roller 19 is arranged so that the woven fabric W is nipped with the surface roller 17 and supported by a shaft rotatably along with the movement of the woven fabric W.

The take-up roller 23 is driven to rotate by for example a rotating feed motor 67 directly or indirectly through a not shown gear train etc. The take-up motor 67 is constituted by for example a servo motor and constitutes a servo mechanism together with an encoder 69 detecting rotation of the take-up motor 67 and a servo driver 71 supplying electric power to the take-up motor 67. The servo driver 71 performs feedback control based on a control signal input from the control device 25 to the servo driver 71 and a detection signal of the encoder 69 so that the position and/or speed of the take-up motor 67 follows the input control signal.

The control device 25, while not particularly shown, includes a CPU, ROM, RAN, and external memory device. The control device 25 generates control signals based on signals from various types of means such as the detection signal from the position detector 35 and outputs those control signals to various types of driving means such as servo drivers 31, 41, 47, 59, 65, and 71. Note that, the control device 25 is constituted by for example a plurality of circuit boards held in one housing. Further, part or all of the various types of the driving means such as the servo drivers 31, 41, 47, 59, 65, and 71 may be held in the housing as well. Note, the control device 25 may be provided dispersed among a plurality of housings as well.

Figure 2A:
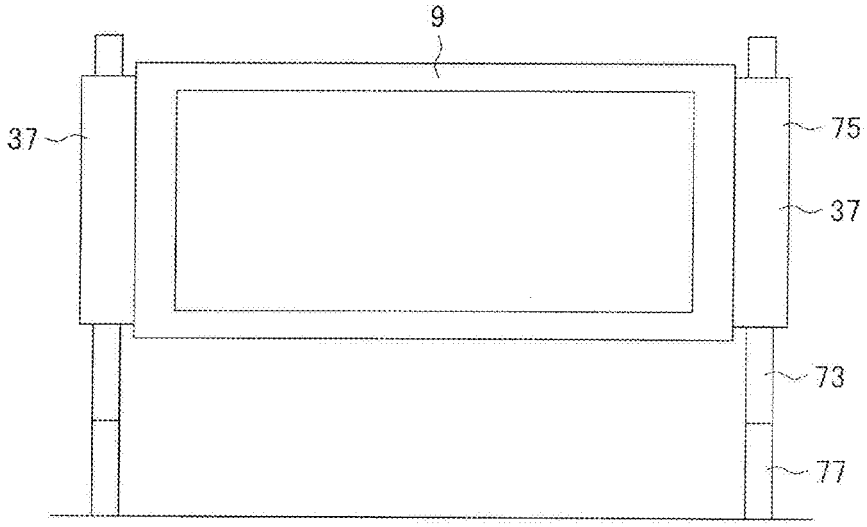
[FIG. 2] A diagram explaining a drive method of a heddle frame of the loom of FIG. 1.
Figure 2B:
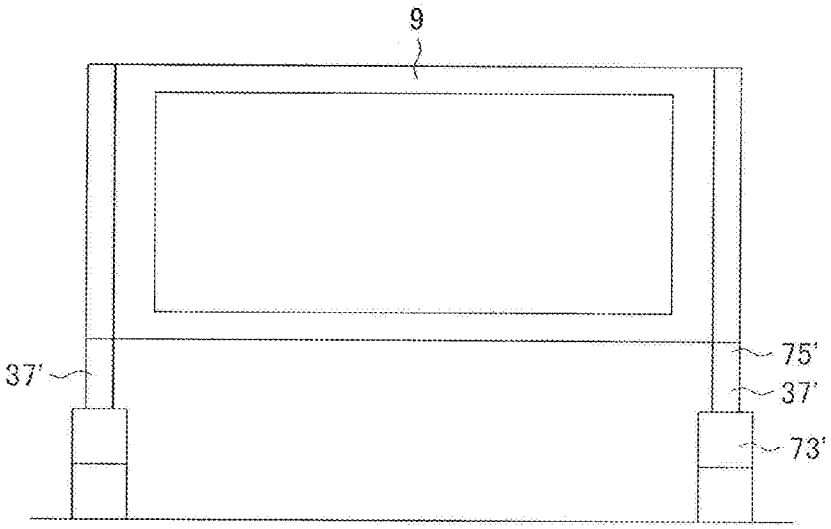

FIG. 2(*a*) is a diagram seen in a passing direction of the warps V showing constitutions of a heddle frame 9 and the heddle linear motor 37. Note that, in FIG. 2(*a*), illustration of the heddles 10 is omitted.

Two heddle linear motors 37 are provided for, for example, each of the plurality of heddle frames 9. The two heddle linear motors 37 corresponding to one heddle frame 9 are provided on the left and right sides of the heddle frame 9 (sideward relative to an advance direction of the warp V). Each heddle linear motor 37, for example, has a stator 73 fixed to a member which becomes the foundation of the loom 1 through a column 77 and a mover 75 fixed to the heddle frame 9, but movable in the movement direction (upward and downward direction on the sheet surface of FIG. 2) of the heddle frame 9 relative to the stator 73.

Note that, the heddle linear motor 37 may be a synchronous type, induction type, or DC type as well. Further, between the stator 73 and the mover 75, either may be a field and either may be an armature. In FIG. 2(*a*), the case of arrangement of the mover 75 around the shaft-shaped stator 73 is shown. However, a stator 73' may also be arranged around the shaft-shaped mover 75' like a heddle linear motor 37' shown in FIG. 2(*b*).

The reed linear motor 43, although particularly not shown, in the same way as the heddle linear motor 37, has a stator directly or indirectly fixed to a member which becomes the foundation of the loom 1 and a mover fixed to the reed 13 and movable in the movement direction (left and right direction of the sheet surface of FIG. 1) of the reed 13 relative to the stator 73. Further, two reed linear motors 43 are for example provided at both the left and right sides of the reed 13 in the same way as the heddle linear motor 37.

Figure 3:
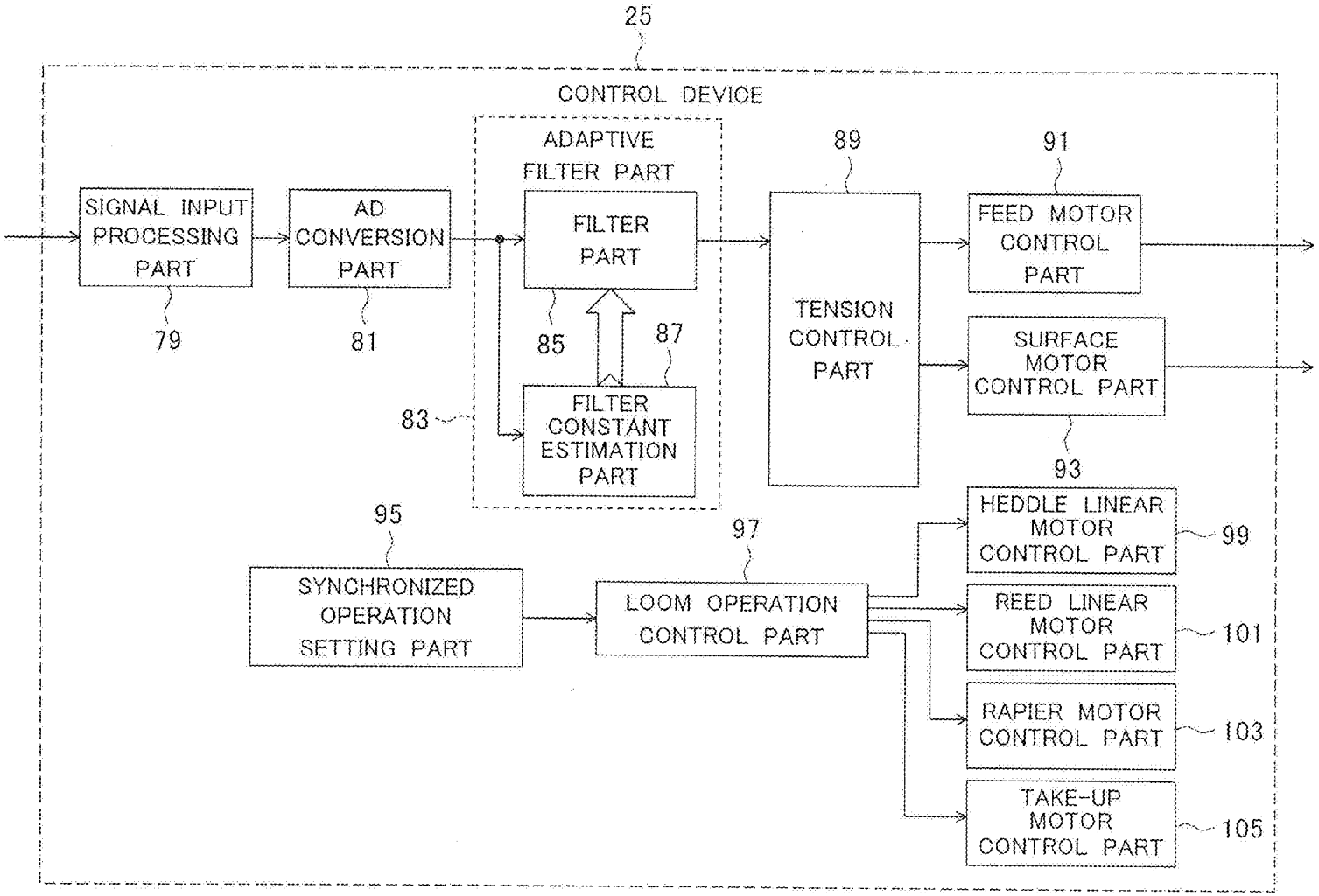
[FIG. 3] A block diagram showing the configuration of a signal processing system of a control device of the loom of FIG. 1.

FIG. 3 is a block diagram showing the configuration of a signal processing system of the control device 25.

First, the configuration concerning the tension control of the warps V will be explained. Tensions of the warps V and the woven fabric W are controlled by feedback control executed by a predetermined period (for example 100 μs to 5 ms) based on the tension detected by the position detector 35. Specifically, the configuration is as follows.

A signal input processing part 79 performs amplification amplifying the detection signal (analog signal) from the position detector 35 or other processing. The signal input processing part 79 includes for example a differential OP amplifier and amplifies a relatively fine detection signal from the position detector 35 up to a level adaptive to AD conversion of about a few volts.

The AD conversion part 81 converts an analog signal amplified by the signal input processing part 79 to a digital signal. Due to this, a voltage value (tension) of the analog signal is held by a binary digital signal as information of for example 16 bits or 24 bits.

Note that, after the processing of the AD conversion part 81, various processing is carried out on the numerical values held by the binary digital signals as information of predetermined numbers bits. Addition etc. of numerical values held by the binary digital signals can be conceptually replaced by addition etc. of signal levels (voltages etc.) of analog signals and actually carried out by the addition etc. of signal levels of analog signals. Therefore, in the explanation of the present application, the processing on numerical values held by the binary digital signals is sometimes expressed as the processing for signals, for example, the addition of numerical values held by the binary digital signals is simply expressed as the addition of signals.

The adaptive filter part 83 filters signals from the AD conversion part 81. Specifically, the adaptive filter part 83 eliminates signals in frequency bands unnecessary for the tension control while maintaining signals in frequency bands necessary for the tension control. The adaptive filter part 83 has a filter part 85 actually performing filtering and a filter constant estimation part 87 estimating the filter constant of the filter part 85 so that the filtering by the filter part 85 is suitably carried out.

The tension control part 89 sets target speeds of the feed motor 27 and the surface motor 61 so as to reduce the difference between the detected tension filtered by the adaptive filter part 83 and the target tension set by a manufacturer or user in advance. For example, the tension control part 89 corrects the present target speed of the feed motor 27 to make it faster and/or corrects the present target speed of the surface motor 61 to make it slower if the detected tension is larger than the target tension, while corrects the present target speed of the feed motor 27 to make it slower and/or corrects the present target speed of the surface motor 61 to make it faster if the detected tension is smaller than the target tension. Note that the correction amounts may be continuously changed in accordance with the deviation between detected tensions and the target tension or set constant when the deviation between the detected tension and the target tension exceeds a predetermined permissible value. Further, proportional control, PD control, PID control, or other appropriate control may be carried out based on the deviation. The tension control device 89 outputs a control signal in accordance with the set target speed of the feed motor 27 to the feed motor control part 91 and outputs the set target speed of the surface motor 61 to the surface motor control part 93.

The feed motor control part 91 generates a control signal in accordance with the control signal input from the tension control part 89 and outputs it to the servo driver 31. In the same way, the surface motor control part 93 generates a control signal in accordance with the control signal input from the tension control part 89 and outputs it to the servo driver 65. For example, the tension control part 89 outputs, as the control signal, a binary digital signal including the target speed as information of the predetermined numbers bits, and the feed motor control part 91 and surface motor control part 93 generate pulse signals having frequencies in accordance with their target speeds and output those. The servo driver 31 (65) performs the feedback control based on the deviation between the count of pulse signals input from the feed motor control part 91 (surface motor control part 93) and the count of pulse signals output from the encoder 29 (63).

Next, the configuration relating to the control of the weaving operation, which is mainly from the opening of the warps V by the heddles 10 to the beating operation, will be explained.

The synchronized operation setting part 95 sets drive periods of the heddle linear motor 37, reed linear motor 43, and rapier motor 55 and drive timings of these motors relative to each other (phase difference of drive periods) based on information stored by the manufacturer in advance and information input by the user via a not shown inputting means or the other information as the initial operation of the loom 1. Namely, a period of forming openings by the heddles 10, a period of picking the wefts H by the picking device 11, and a period of beating by the reed 13 are set, and the timings of these operations relative to each other are set.

Note that, in the example shown in FIG. 1, the period of the picking operation and the period of the beating operation are the same. The period of the heddles 10 (one reciprocal movement) is two times the period of the picking and the period of the beating. The period of the picking and beating is for example 25 ms. Further, drive timings are set in an order of the opening by the heddles 10, picking, and beating.

The synchronized operation setting part 95, in addition, sets drive timings (phases), speeds, suspension positions etc. when performing predetermined operations in one period for motors (37, 45, 55) and sets the speed of the take-up motor 67 based on the information stored by the manufacturer in advance and information input by the user via a not shown inputting means or the other information.

Note that, the synchronized operation setting part 95 sets periods, phase differences, phases, etc. described above in accordance with the information input by the user or the other information, therefore it will be understood that these settings can be changed in accordance with information etc. input by the user.

The loom operation control part 97 generates control signals and outputs these to a heddle linear motor control part 99, reed linear motor control part 101, rapier motor control part 103, and take-up motor control part 105 at a predetermined period (for example 100 μs to 5 ms) so that the motors (37, 45, 55, and 67) operate by drive periods and at drive timings set by the synchronized operation setting part 95. The control signals include for example target positions and/or target speeds of motors.

The heddle linear motor control part 99, reed linear motor control part 101, rapier motor control part 103, and take-up motor control part 105, in the same way as the feed motor control part 91 and surface motor control part 93, generate control signals (for example pulse signals) in accordance with input control signals and output these to servo drivers 41, 47, 59, and 71. The servo drivers 41, 47, 59, and 71, for example, in the same way as servo drivers 31 and 65, perform feedback control based on deviations between the counts of pulse signals input from the control parts (99, 101, 103, 105) and counts of pulse signals output from the encoders 39, 45, 57, and 69.

Figure 4:
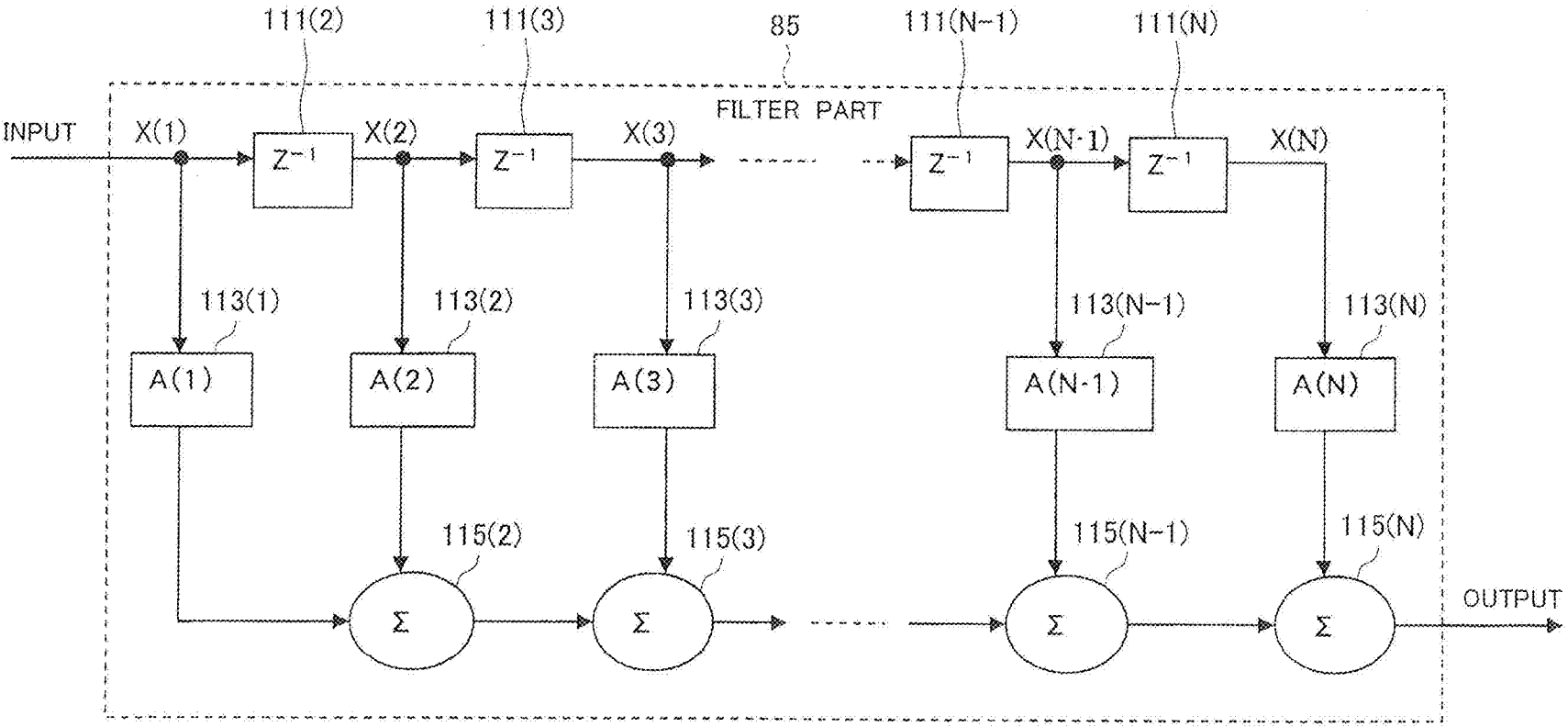
[FIG. 4] A block diagram showing the configuration of a filter part of the control device of FIG. 3.

FIG. 4 is a block diagram showing the configuration of the filter part 85.

The filter part 85 is constituted by for example a so-called finite length impulse response (FIR) filter and has a plurality (N−1) of delay elements 111(2) to 111(N) (hereinafter sometimes (2), (N), etc. are omitted or expressed generalized as 111(*n*), true for other notations and coefficients as well) connected in series so as to sequentially delay input signals (X(1)), a plurality (N) of multipliers 113(1) to 113(N) multiplying input signals (X(1)) and signals (X(2) to X(N)) sequentially delayed by the plurality of delay elements 111 by tap gains (filter coefficients) A(1) to A(N), and a serially connected plurality (N−1) of adders 115(2) to 115(N) for accumulating N signals multiplied by tap gains A. The filter part 85 outputs filtered signals from the adders 115 (N).

N is appropriately set by considering the period of sampling signals from the position detector 35, the period of the weaving operation, and so on. For example, N is 5 to 250. Note that, in general, when N is made too large, the attenuation effect of the filter becomes too large and the fluctuation required for controlling the tension is attenuated as well. However, in the filter part 85, as will be explained later, the tap gain A(n) is optimized by the filter constant estimation part 87. Therefore, even if N is large, the tap gain A(n) in which n is large becomes small, therefore such a problem does not occur. Accordingly, preferably N is made sufficiently large in a range where the amount of processing does not become too large.

Figure 5:
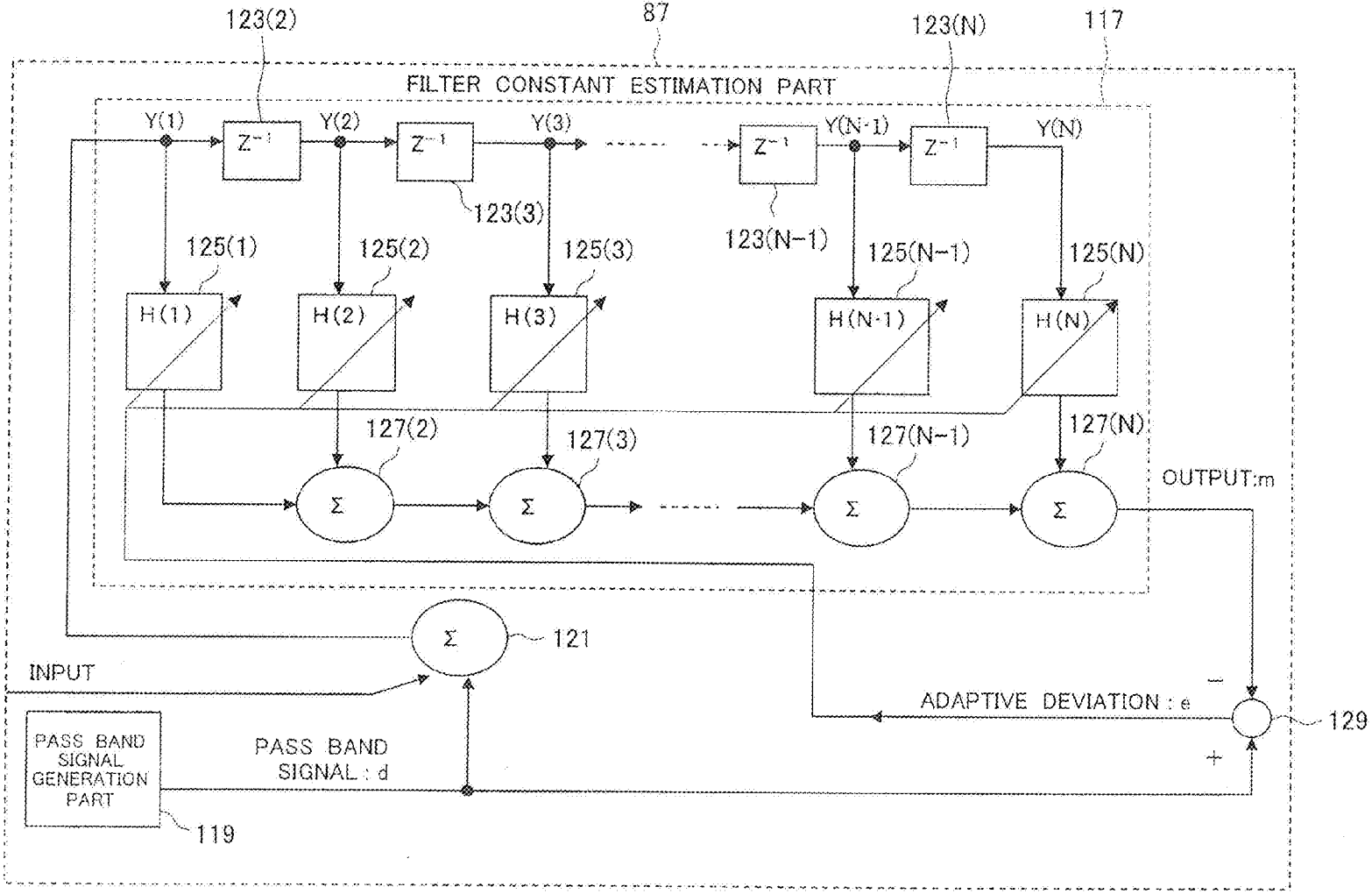
[FIG. 5] A block diagram showing the configuration of a filter constant estimation part of the control device of FIG. 3.

FIG. 5 is a block diagram showing the configuration of the filter constant estimation part 87.

The filter constant estimation part 87 has an estimation-use filter part 117. Tap gains H(1) to H(N) in the estimation-use filter part 117 are copied as tap gains A(1) to A(N) of the filter part 85 to the multipliers 113(1) to 113(N) at the time of the end of estimation or during the estimation and used. Specifically, this is as follows.

The filter constant estimation part 87 has a pass band signal generation part 119 generating and outputting a pass band signal d. The tap gain H of the estimation-use filter part 117 is calculated so that, even if the pass band signal d is filtered by the estimation-use filter part 117, it is not attenuated.

To the estimation-use filter part 117, a signal output from the AD conversion part 81 and the pass band signal d are added by the adder 121 and input. The estimation-use filter part 117 has a plurality (N−1) of delay elements 123(2) to 123(N) connected in series so as to sequentially delay input signals (Y(1)), a plurality (N) of tap constant estimation parts 125(1) to 125(N) multiplying the input signal (Y(1)) and signals (Y(2) to Y(N)) sequentially delayed by the plurality of delay elements 123 by tap gains H(1) to H(N), and a plurality (N−1) of serially connected adders 127(2) to 127(N) for accumulating N signals multiplied by tap gains H. The estimation-use filter part 117 outputs an output signal m after filtering from the adder 127 (N).

The output signal m and pass band signal d are input to a subtractor 129, where a difference (adaptive deviation e) is calculated. The adaptive deviation e is input to the tap constant estimation part 125. The tap constant estimation part 125 estimates the tap gain H so as to make the adaptive deviation e zero.

The adaptive deviation e becoming zero means that the estimation-use filter part 117 has the feature of passing the pass band signal d and cutting only the input signal (signal from the AD conversion part 81). Namely, the estimation-use filter part 117 has a desired filter characteristic. Subtraction of the output signal m and the pass band signal d corresponds to applying a band restriction of the pass band. This band is determined by a pass band setting filter 133 explained later.

Figure 6:
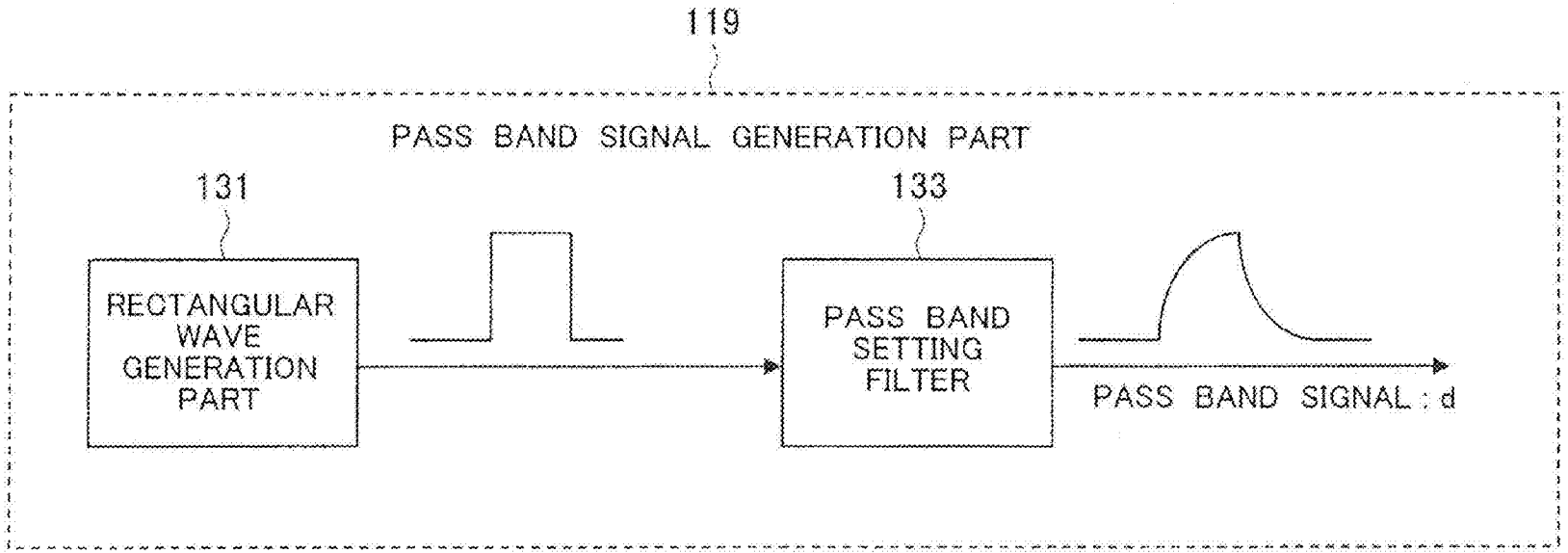
[FIG. 6] A block diagram showing the configuration of a pass band signal generation part of the filter constant estimation part of FIG. 5.

FIG. 6 is a block diagram showing the configuration of a pass band signal generation part 119.

The pass band signal generation part 119 has a rectangular wave generation part 131 generating a rectangular wave and a pass band setting filter 133 filtering that rectangular wave and generating a pass band signal d. The pass band setting filter 133 is for example a low pass filter. The cutoff frequency is appropriately set, for example, in a range not less than the frequency of beating etc. (for example 1/25 ms) or not less than the frequency of the beating and the movement of the heddles (for example, 1/(25 ms/2) if one fluctuation due to the beating and one fluctuation due to movement of the heddles 10 occur in 1 period of the beating) so that the fluctuation of tension due to the opening of the warps V by the heddles 10 or beating which occurs in one period of beating etc. (for example 25 ms) is eliminated, but the response of the tension control becomes high. Note that, the pass band setting filter 133 is not limited to a low pass filter and may be a band eject filter etc. as well.

Figure 7:
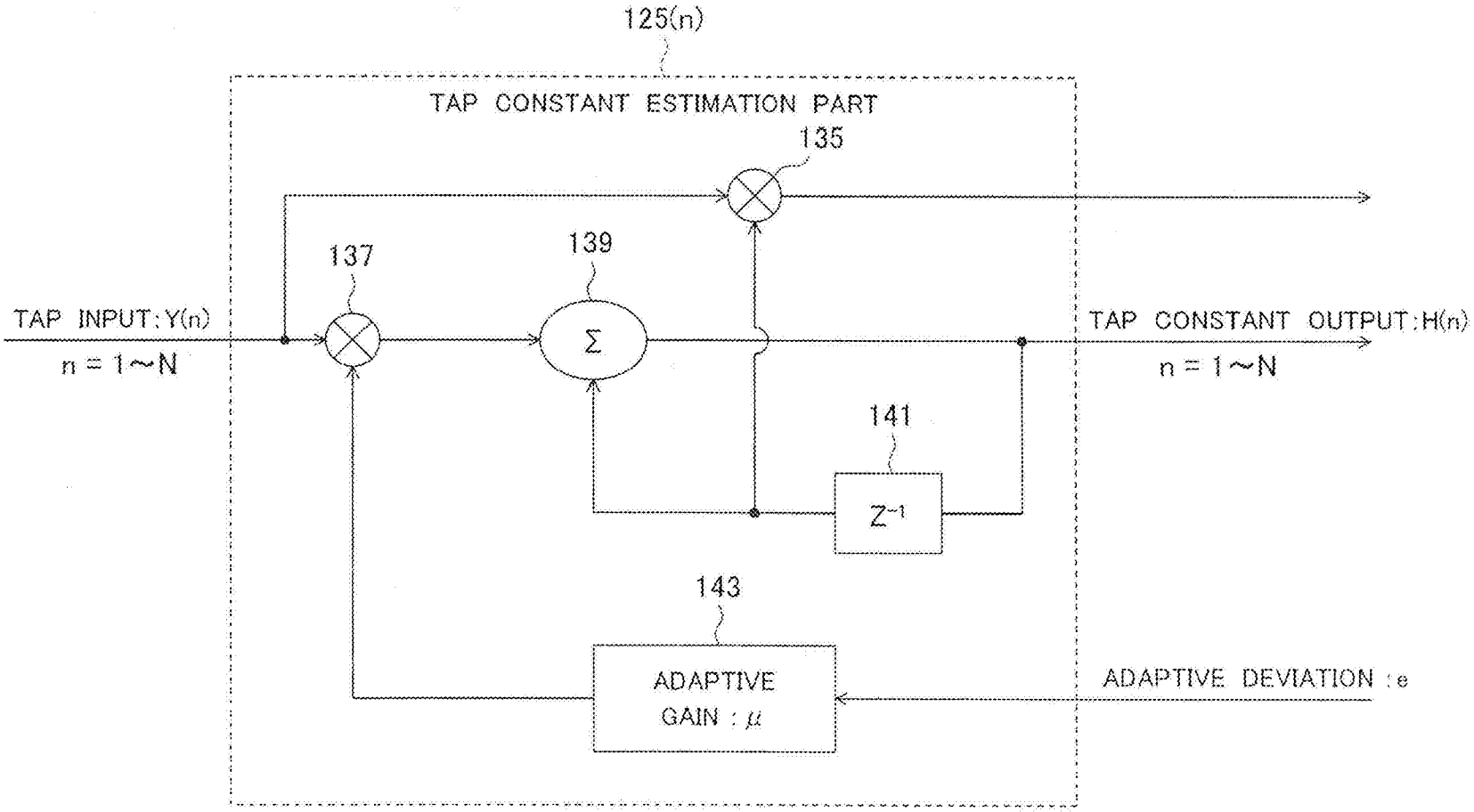
[FIG. 7] A block diagram showing the configuration of a tap constant estimation part of the filter constant estimation part of FIG. 5.

FIG. 7 is a block diagram showing the configuration of the tap constant estimation part 125.

The tap constant estimation part 125, as explained above, multiplies the input signal Y(n) (signal from AD conversion part 81+pass band signal d) by the estimated tap gain H(n) and outputs the result. Specifically, the tap constant estimation part 125 multiplies the signal Y(n) by the previous estimated tap gain H(n) held in the delay element 141 by the multiplier 135 and outputs the result. This output signal is added by the adder 127 and provided for the generation of the output signal m as explained above.

Further, the tap constant estimation part 125 is configured to estimate the tap gain H by a so-called least mean square (LMS) algorithm and output the result. Specifically, the tap constant estimation part 125 has a multiplier 143 multiplying the adaptive deviation e by the adaptive gain (step size parameter) μ, a multiplier 137 multiplying the value (μe) calculated by the multiplier 143 to the input signal Y(n), and an adder 139 adding the value (μeY(n)) calculated by the multiplier 137 and the previous estimated tap gain H(n) held in the delay element 141.

Note that, the adaptive gain μ is a constant determining the speed of adaptation and appropriately set by the manufacturer or user considering the possibility that a long time is taken for adaptation when it is small and the response vibrates and becomes scattered when it is large.

According to the above embodiment, the loom 1 has a warp beam 3 around which warps V is wound, a feed motor 27 rotating the warp beam 3 in a direction feeding the warps V, heddles 10 opening and closing the warps V fed from the warp beam 3, a picking device 11 inserting the wefts H through the openings of the warps V formed by the heddles 10, a reed 13 beating the wefts H inserted in the openings of the warps V by the picking device 11, a surface roller 17 pulling in the woven fabric W which is beaten by the reed 13 and formed by the warps V and the wefts H, a surface motor 61 rotating the surface roller 17 in the direction pulling in the woven fabric W, a position detector 35 indirectly detecting a tension of the warps V between the warp beam 3 and the surface roller 17, and a control device 25 having an adaptive filter part 83 filtering the tension detected by the position detector 35 and controlling a feed motor 27 and a surface motor 61 so that the tension of the warps V becomes the predetermined target tension based on the tension filtered by the adaptive filter part 83. Therefore, even if periods of the heddles 10 and beating change, the tension of the warps V can be controlled with a relatively high response while suitably eliminating the fluctuation of tension occurring due to the up and down movement of the heddles 10 and beating. As a result, a manufacturer providing the drive part concerning the tension control of the loom 1 (the feed motor 27, surface motor 61, and the control device 25 controlling these) can provide drive parts which can be used for various looms and woven fabrics.

Further, in general, the heddles 10, reed 13, and other members concerning the weaving operation operate synchronized with the main motor by the rotation of the main motor transmitted through the link mechanism and gear mechanism, therefore mutual timings of members are mechanically defined by the link mechanism and gear mechanism. However, the tension can be controlled by the adaptive filter part 83 to flexibly handle changes of the weaving operation, therefore the feasibility of driving the heddles 10 and reed 13 not by the main motor, but by motors provided corresponding to those becomes higher. As a result, it becomes possible to transmit parallel movement of the linear motor directly to the heddles 10 and the reed 13 by providing linear motors (37, 43) determining directions of movement of the heddles 10 and the reed 13 as the drive direction of the mover. In other words, by omitting the transmission mechanism transforming the rotation of the rotating motor (main motor) to parallel movements of the heddles 10 and the reed 13, reduction of backlash error and other various effects can be obtained.

Further, by the adaptive filter part 83, changes of period of up and down movement of the heddles 10 or the beating operation, and drive timing can be flexibly coped with. Therefore, for the user, the feasibility of setting and changing periods of the heddles 10 or the reed 13, mutual drive timings (phase difference) of these, etc. is improved as well.

Further, the filter constant estimation part 87 of the adaptive filter part 83 has an estimation-use filter part 117 separately from the filter part 85, filters the result of addition of the pass band signal d and the input signal (signal from the AD conversion part 81), estimates the tap gain H of the estimation-use filter part 117 so as to reduce the deviation between the filtering result thereof (output signal m) and the pass band signal d, and sets the tap gain H as the tap gain A of the filter part 85, therefore the tap gain A can be estimated so that fluctuation of an unnecessary frequency band can be suitably cut.

Note that, in the above embodiment, the surface roller 17 is an example of the pull-in roller of the present invention, the surface motor 61 is an example of the pull-in motor of the present invention, the position detector 35 is an example of the detector detecting the tension of the present invention, the tap gain A is an example of the first filter coefficient of the present invention, the delay element 111 is an example of the first delay element of the present invention, the multiplier 113 is an example of the first multiplier of the present invention, the combination of the plurality of adders 115 is an example of the first accumulation part of the present invention, the delay element 123 is an example of the second delay element of the present invention, the tap gain H is an example of the second filter coefficient of the present invention, the multiplier 135 is an example of the second multiplier of the present invention, the combination of the plurality of adders 127 is an example of the second accumulation part of the present invention, and the combination of the feed motor 27, surface motor 61, and control device 25 in the loom 1 is an example of the drive device of the loom of the present invention.

The present invention is not limited to the above embodiment and may be executed in various ways.

The driving method of the heddles, reed, picking device, and take-up roller is not limited to drive by motors provided corresponding to these. For example, as in the conventional case, the motion of one rotating motor may be transmitted through a link mechanism and gear mechanism to the members. Further, the motor is not limited to a servo motor and may be for example a step motor as well. As motors driving members, for example, driving the heddles and reed by rotating motors, either rotating motors or linear motors may be appropriately selected. It is not necessary to provide two linear motors for driving the heddles and the reed for each heddle frame and reed. For example, one heddle frame may be driven by one linear motor as well.

The number of heddle frames, drive timing, etc. may be appropriately set in accordance with the type etc. of the woven fabric. The picking device is not limited to the rapier type and may be for example a shuttle type, gripper type, air type, or water type as well. The pull-in roller is not limited to the surface roller (17) before the take-up roller. For example, the pull-in roller may be a take-up roller (23) as well.

The detector only has to detect the tension of the warps between the feed roller and the pull-in roller and is not limited to one detecting the tension upstream of the shed rods 7. For example, the tension of the warps (tension of the woven fabric) may be detected between the reed and the pull-in roller as well. Further, the detector detecting the tension is not limited to a position detector. For example, the detector may be a load cell including a piezoelectric element which directly detects a load added to the tension roller 5 as well.

The filter constant estimation part (87) is not limited to one having an estimation-use filter part 117 filtering the result of addition of the pass band signal (d) and the signal to the filter part (85) (signal from the AD conversion part 81) in the same way as the filter part (85). For example, it may be one calculating the deviation between the output of the filter part (85) and the pass band signal (d) and estimating the first filter coefficient (tap gain A) so that the deviation becomes small as well. The algorithm estimating the second filter coefficient (first filter coefficient) is not limited to a least mean square algorithm. For example, use may be made of for example a steepest descent algorithm as well.

The pass band signal is not limited to one generated based on a rectangular wave signal. For example, the pass band signal may be generated based on an SIN wave signal etc. which continuously changes as well. Further, the pass band signal is not limited to one generated by passing it through the pass band setting filter (133). For example, the pass band signal may be directly generated based on time series data set in advance.

Detectors detecting rotations of motors etc. (encoders 29, 39, 45, 57, 63, and 69 in the embodiment) are not limited to encoders. These may be for example resolvers as well.

The invention claimed is:

1. A loom comprising:

a warp beam around which warps are wound;

a feed motor rotating the warp beam in a direction feeding the warps;

a heddle opening and closing the warps fed from the warp beam;

a picking device inserting wefts into the openings of the warps formed by the heddle;

a reed beating down the wefts inserted in the openings by the picking device;

a pull-in roller pulling in a woven fabric beaten down by the reed and formed by the warps and the wefts;

a pull-in motor rotating the pull-in roller in a direction pulling in the woven fabric;

a detector detecting a tension of the warps between the warp beam and the pull-in roller; and a control device having an adaptive filter filtering the tension detected by the detector, and controlling the feed motor and the pull-in motor so that the tension of the warps becomes a predetermined target tension based on the tension filtered by the adaptive filter;

wherein the adaptive filter includes:

a filter part filtering tension detected by the detector by using a plurality of first filter coefficients, and a filter constant estimation part calculating the plurality of first filter coefficients;

the filter part includes:

a plurality of first delay elements sequentially delaying tension detected by the detector, a plurality of first multipliers multiplying outputs of the plurality of first delay elements by the first filter coefficients corresponding to the first delay elements, and a first accumulation part accumulating results of multiplication of the plurality of first multipliers and outputting the result of the accumulation as the filtered tensions;

the filter constant estimation part includes:

a pass band signal generation part generating a pass band signal, an adder adding the tension detected by the detector and the pass band signal, an estimation filter part filtering results of addition of the adder by using a plurality of second filter coefficients, a subtractor calculating a deviation between the output filtered by the estimation filter part and the pass band signal, and a tap constant estimation part calculating a plurality of second filter coefficients so that the deviation becomes small;

the estimation filter part includes:

a plurality of second delay elements sequentially delaying results of addition of the adder, a plurality of second multipliers multiplying outputs of the plurality of second delay elements by the second filter coefficients corresponding to the delay elements, and a second accumulation part accumulating results of multiplication of the second multipliers and outputting the result of the accumulation as the filtering result, the tap constant estimation part calculates the plurality of second filter coefficients so that the deviation becomes small; and the calculated plurality of second filter coefficients are set as the first filter coefficients in the filter part.

2. A loom as set forth in claim 1, further comprising:

a heddle linear motor driving the heddle and having a direction of movement of the heddle as a drive direction of a mover.

3. A loom as set forth in claim 2, further comprising:

a reed linear motor driving the reed and having a direction of movement of the reed as a drive direction of a mover.

4. A loom as set forth in claim 3, wherein the control device has a synchronized operation setting part capable of changing driving periods of the heddle linear motor and the reed linear motor and drive timings of these relative to each other and controls the heddle linear motor and the reed linear motor based on the driving periods and drive timings changed by the synchronized operation setting part.

5. A drive device of a loom comprising:

a feed motor rotating a warp beam around which warps are wound in a direction feeding the warps;

a pull-in motor rotating a pull-in roller pulling in a woven fabric formed by beating wefts inserted into openings of the warps fed from the warp beam in a direction of pulling in the woven fabric; and a control device having an adaptive filter filtering the tension detected between the warp beam and the pull-in roller, and controlling the feed motor and the pull-in motor so that the tension of the warps becomes a predetermined target tension based on the tension filtered by the adaptive filter.

* * * * *